US009972465B2

(12) United States Patent
Wang

(10) Patent No.: US 9,972,465 B2
(45) Date of Patent: May 15, 2018

(54) SILENT KEYBOARD

(71) Applicant: Wei-Ming Wang, Taipei (TW)

(72) Inventor: Wei-Ming Wang, Taipei (TW)

( * ) Notice: Subject to any disclaimer, the term of this patent is extended or adjusted under 35 U.S.C. 154(b) by 167 days.

(21) Appl. No.: 15/064,888

(22) Filed: Mar. 9, 2016

(65) Prior Publication Data

US 2017/0069445 A1 Mar. 9, 2017

(30) Foreign Application Priority Data

Sep. 8, 2015 (TW) ..... 104129737 A
Nov. 3, 2015 (TW) ..... 104136230 A

(51) Int. Cl.
*H01H 13/7065* (2006.01)
*H01H 13/704* (2006.01)

(52) U.S. Cl.
CPC ..... *H01H 13/7065* (2013.01); *H01H 13/704* (2013.01); *H01H 2209/074* (2013.01); *H01H 2221/002* (2013.01); *H01H 2221/03* (2013.01); *H01H 2221/044* (2013.01)

(58) Field of Classification Search
CPC ..... H01H 13/7065; H01H 13/704; H01H 2209/074; H01H 2221/002; H01H 2221/03; H01H 2221/044
USPC ... 200/5 A, 344–345, 302.1, 302.3, 339, 5 R
See application file for complete search history.

(56) References Cited

U.S. PATENT DOCUMENTS 5,794,762 A * 8/1998 Tsai ..... H01H 13/705 200/345
6,239,391 B1 * 5/2001 Nishijima ..... H01H 13/7006 200/302.2
6,542,355 B1 * 4/2003 Huang ..... G06F 3/0202 312/223.2
6,963,039 B1 * 11/2005 Weng ..... H01H 23/06 200/302.1

FOREIGN PATENT DOCUMENTS

| | | |
|---|---|---|
| JP | 2003-16868 A | 1/2003 |
| JP | 2010-118230 A | 5/2010 |
| TW | 274142 | 4/1996 |
| TW | 373796 | 11/1999 |
| TW | 201428798 A | 7/2014 |
| TW | 2015-30585 A | 8/2015 |

* cited by examiner

*Primary Examiner* — Edwin A. Leon
(74) *Attorney, Agent, or Firm* — Trojan Law Offices

(57) ABSTRACT

A keyboard device includes an upper housing, a conductive membrane, a key top including a bottom surface and an actuator disposed on the bottom surface, a lower housing and a soft elastic element located on the conductive membrane, wherein the actuator penetrates the upper housing, and the soft elastic element has an engaging part to engage with the key top such that the key top is prevented from being separated from the soft elastic element when the key top rebounds.

20 Claims, 10 Drawing Sheets

SILENT KEYBOARD

CROSS-REFERENCE TO RELATED APPLICATION AND CLAIM OF PRIORITY

This application claims the benefit of Taiwan Patent Application No. 104129737 filed on Sep. 8, 2015 and Taiwan Patent Application No. 104136230 filed on Nov. 3, 2015, at the Taiwan Intellectual Property Office, the disclosures of which are incorporated herein in their entirety by reference.

FIELD OF THE INVENTION

The present invention is related to a keyboard device using a silicone rubber dome to conduct two membranes, and specifically to a silent keyboard device using the top part of the silicone rubber dome to hold a key top.

BACKGROUND OF THE INVENTION

The common keyboard used for a computer always makes sounds when the keys are tapped, but these sounds often bother users who need quiet. In addition, some people use their keyboards in the office during lunchtime, and these sounds could disturb other people who are trying to take a break. Please refer to FIG. 1, which is a cross-sectional view of a conventional keyboard structure. A keyboard 10 includes a key top 11, a butting column 12 (which may also be referred to as a crater), a central post 13, two protrusions 14 moving within the butting column 12 in a balanced manner, left and right side portions 15, left and right top portions 16 (i.e., a stopping piece, which has a regular height/thickness (DP) of 1.4 mm), a bottom portion 17, a conductive membrane 171, a silicone rubber dome 18 and two outer portions 19, wherein the outer portions 19 are embedded below a keyboard surface 101 of the keyboard 10 with an embedded depth (ED) of 2 mm. Each of the two surrounding parts 181 of the silicone rubber dome 18 around the central post 13 has a height (HT) of 0.8 mm.

The reason why the existing keyboard 10 makes noise can be understood from FIG. 1. It is usually nothing more than the sounds caused by the side portions 15 hitting an urging surface 161 of the top portion 16 and the protrusions 14 hitting the bottom portion 17 when the key top 11 is pressed down (of course, if the central post 13 pushes the silicone rubber dome 18 to hit the conductive membrane 171, the protrusions 14 no longer hit the bottom portion 17, and a clicking sound caused by hitting the bottom portion 17 does not occur), and the sound caused by the protrusions 14 hitting a stopping surface 162 of the top portion 16 after the central post 13 of the key top 11 is the rebound of the silicone rubber dome 18 (where the stopping surface 162 prevents the protrusions 14 from disengaging and falling off). That is to say, when pressing down the keys of the keyboard 10, the sounds are made by the key top 11 hitting the bottom portion 17 (hereinafter abbreviated as 'site A'), the urging surface 161 (hereinafter abbreviated as 'site B') and the stopping surface 162 (hereinafter abbreviated as 'site C').

Therefore, the objective is to eliminate the problem of clicking sounds made at sites A, B and C when pressing down the keys of the keyboard. The inventor of the present application endeavored in experiments, tests and research, and has finally created a keyboard device, where clicking sounds made at sites A, B and C not only effectively disappear when pressing the keys, but it also makes typing more fluent. In other words, the problems to be solved by the present invention are, when using the keyboard, how to overcome the problem of clicking sounds made at site C (so as to make the key top rebound soundlessly), site A and site B. The summary of the present invention is described below.

SUMMARY OF THE INVENTION

In the present invention, a keyboard device is disclosed. The keyboard device includes an upper housing, a conductive membrane, a key top including a bottom surface and an actuator disposed on the bottom surface, a lower housing and a soft elastic element located on the conductive membrane, wherein the actuator penetrates the upper housing, and the soft elastic element has an engaging part to engage with the key top such that the key top is prevented from being separated from the soft elastic element when the key top rebounds.

From another point of view of the main technique, the keyboard device of present invention includes an upper housing, a key top moving in a vertical direction relative to the upper housing in response to an actuating pressure, a lower housing and an elastic body disposed on the lower housing bearing the actuating pressure and preventing the key top from colliding with the upper housing in the vertical direction when the key top rebounds after the actuating pressure is released.

According to a further point of view, the present invention encompasses a keyboard device having an upper housing and a lower housing. The keyboard device includes a key top vertically slidably disposed within the keyboard device, and an elastic body disposed on the lower housing and holding the key top away from contacting with either one of the upper housing and the lower housing when the key top rebounds after the key top is removed from an external force.

Other objectives, advantages and efficacies of the present invention are described in detail below taken from the preferred embodiments with reference to the accompanying drawings.

DETAILED DESCRIPTION OF THE PREFERRED EMBODIMENTS

Figure 1:
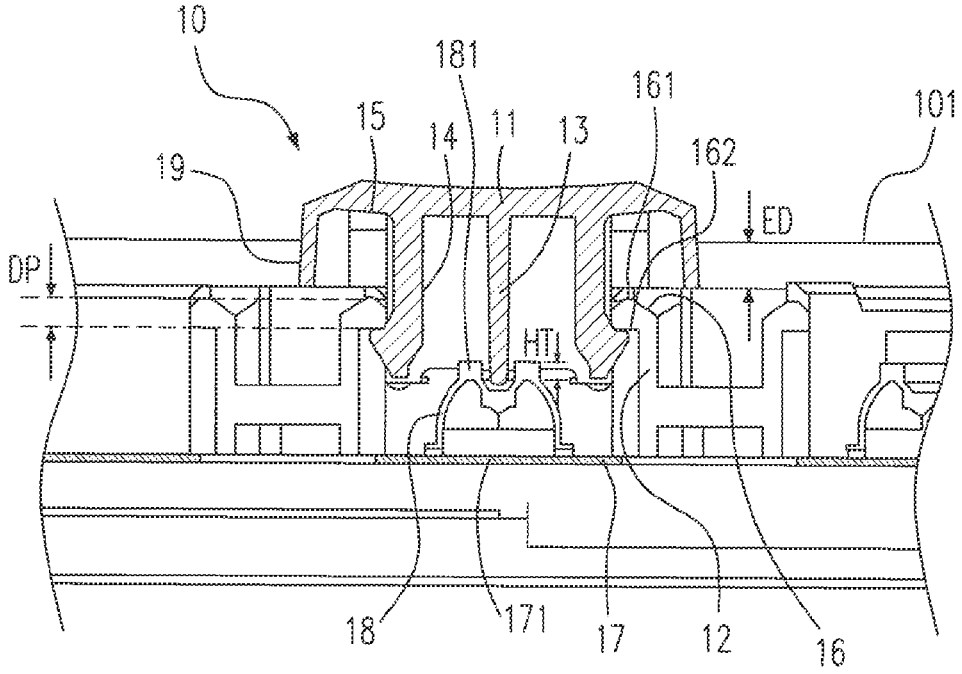
Fig. 1(Prior Art)
FIG. 1 is a cross-sectional view of a conventional keyboard structure.

The present invention will now be described more specifically with reference to the following Embodiments. It is to be noted that the following descriptions of preferred Embodiments of this invention are presented herein for the purpose of illustration and description only; they are not intended to be exhaustive or to be limited to the precise form disclosed. In the preferred embodiments, the same reference numeral represents the same element in each embodiment.

Figure 2:
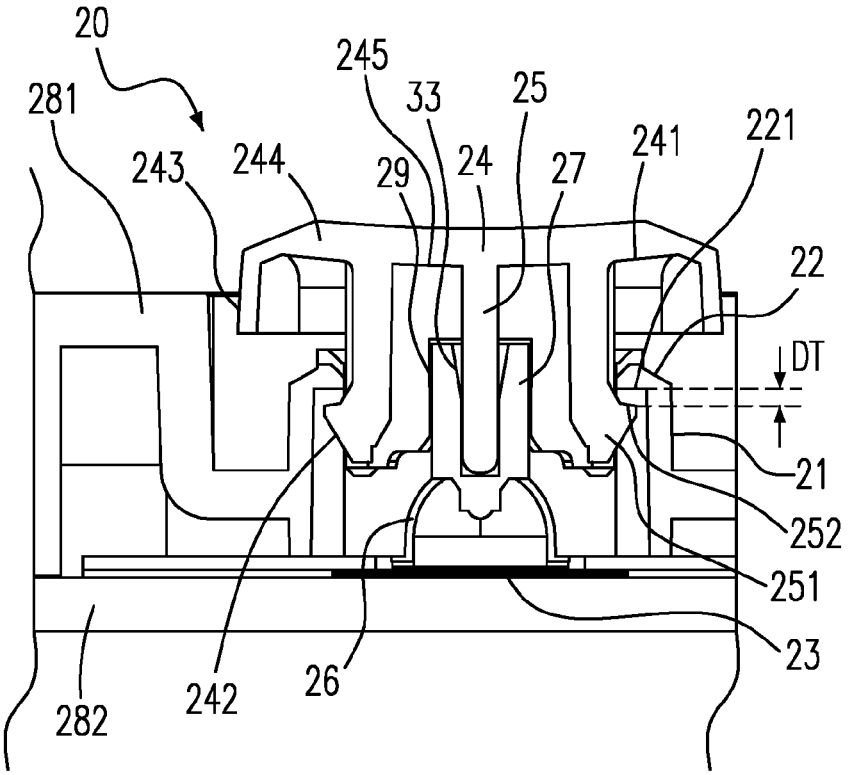
FIG. 2 is a cross-sectional view of the keyboard device according to a preferred embodiment of the present invention.

To eliminate the clicking sound made at site C when the key top rebounds, a keyboard device 20 is shown in FIG. 2. The keyboard device 20 includes an upper housing 281, two conductive membranes 23 (with a layer of plastic sheet between the two membranes), a key top 24 including a bottom surface 241 and an actuator (also called a first holding portion) 25 (that has a diameter greater than that of the central post 13 in FIG. 1, and penetrates the upper housing 281) disposed on the bottom surface 241, a lower housing 282, and a soft elastic element 26 located on the conductive membrane 23. The soft elastic element 26 has an engaging part (also called a second holding portion) 27 to engage with the key top 24 such that the key top 24 is prevented from being separated from the soft elastic element 26 when the key top 24 rebounds. The upper housing 281 further includes two butting columns 21, which have two top portions 22 being stopping portions. Each top portion 22 has a stopping surface 221, and the key top 24 has an urging portion 251 that has an engaging surface 252.

Figure 3:
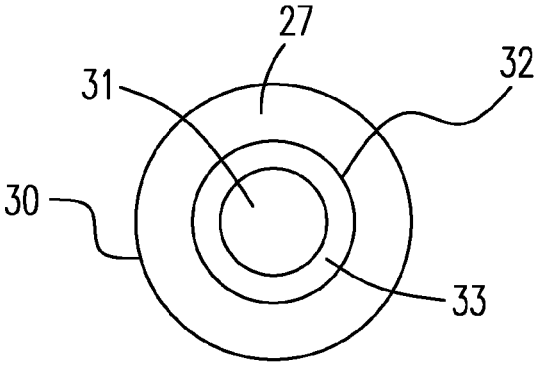
FIG. 3 is a top view of the top part shown in FIG. 2.
Figure 4:
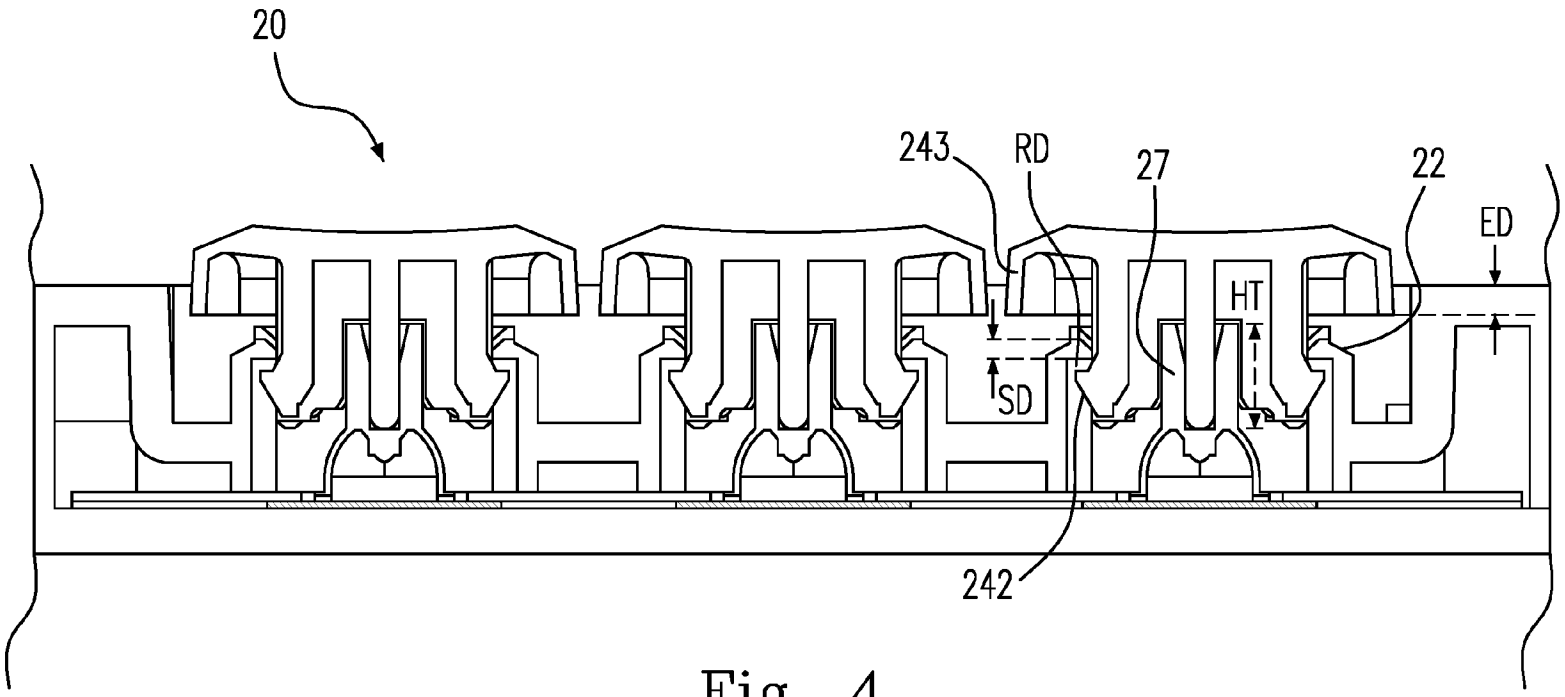
FIG. 4 is a cross-sectional view of the embedded depth of the key top of the keyboard device of the present invention.
Figure 5:
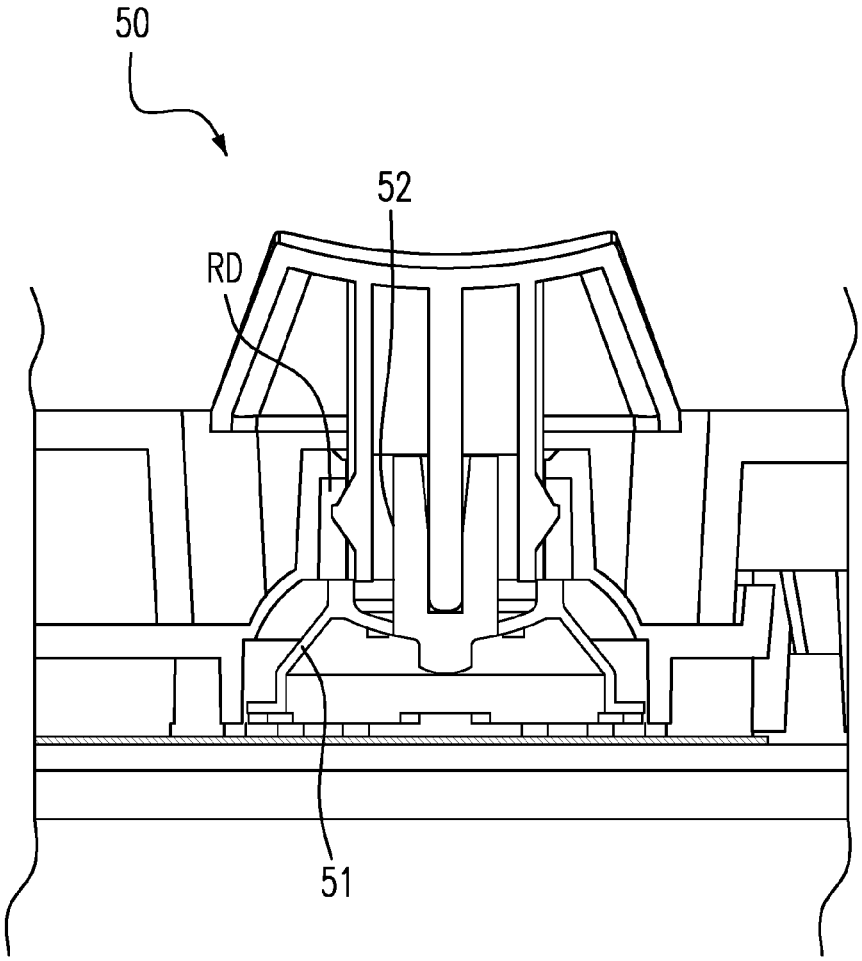
FIG. 5 is a cross-sectional view according to another embodiment of the present invention, in which the keyboard device is applied to a traditional keyboard.

The actuator 25 is a first central post 25 penetrating the butting column 21, and the key top 24 will not hit the stopping portion 22 when the key top 24 rebounds. The soft elastic element 26 is a silicone rubber dome, a rubber hemisphere or other soft elastic body, and the engaging part 27 is the top part. This keyboard device 20 is a thin keyboard, in which each key has a shorter key structure 29. Please refer to FIG. 3, the engaging part 27 is a first recessed cylinder 30 having a height (HT) of 5 mm, and the first recessed cylinder 30 has a first central recess 31 to hold the first central post (also called the first holding portion) 25. The first recessed cylinder 30 further includes an opening 32 having a tapered surface 33, and the cross-sectional area of the opening 32 decreases along the tapered surface 33 inside the first recessed cylinder 30 to facilitate insertion of the first central post 25 into the first central recess 31. The key top 24 further includes two protrusions 242 disposed on the bottom surface 241, two outer portions 243 and two side portions 244. The key top 24 engages with the butting column 21 via the protrusions 242, and the bottom surface 241 includes a recess 245 where the first central post is located. Please refer to FIG. 4, the top portion. 22 further has a reduced thickness (RD) that may be 0.5 mm, to leave at least a gap between the protrusion 242 and the top portion 22. The top portion 22 has a slot thickness (SD) of 0.9 mm (while the thickness of the top portion 16 in FIG. 1 is 1.4 mm), and the outer portion 243 has an embedded depth (ED) of 1.5 mm. Of course, the keyboard device 20 can also be replaced with a traditional keyboard 50 as shown in FIG. 5, which includes a larger silicone rubber dome 51 and a taller key structure 52, and has a similar reduced thickness (RD).

Figure 6A:
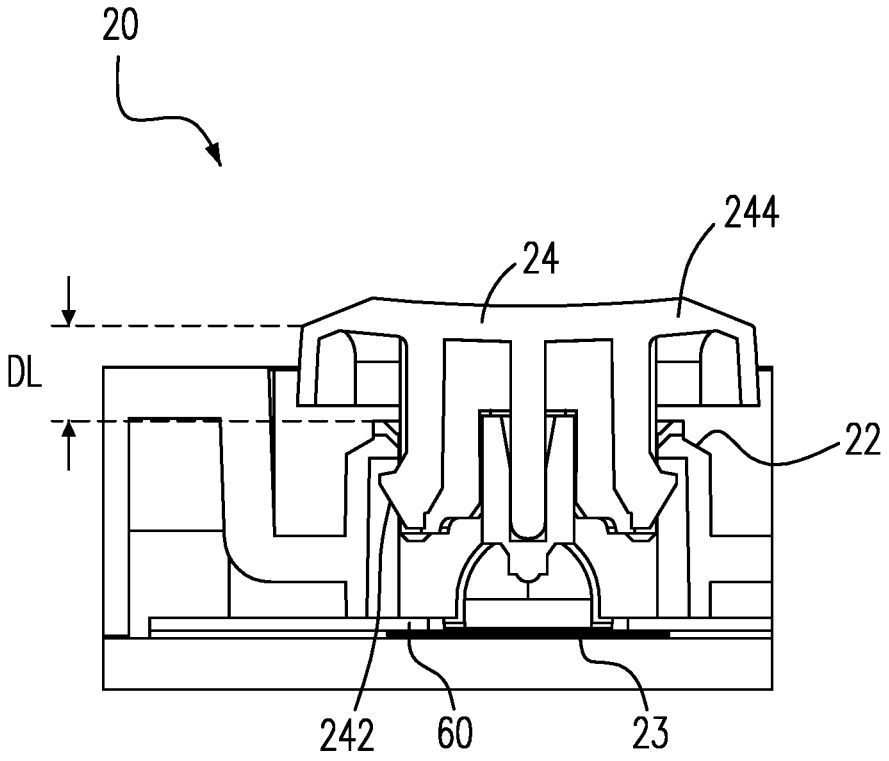
FIG. 6A is a cross-sectional view illustrating a preferred embodiment of the keyboard device of the present invention that uses a bottom pad to urge against the protrusions.
Figure 6B:
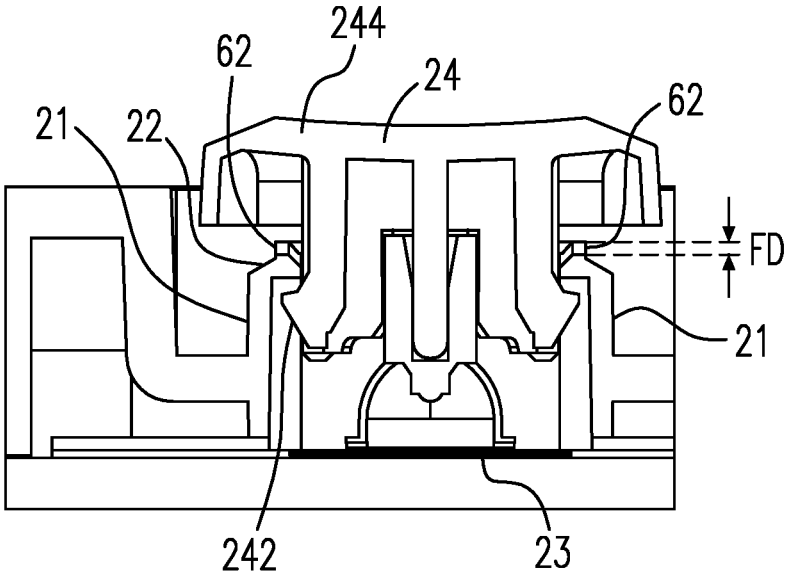
FIG. 6B is a cross-sectional view illustrating a preferred embodiment of the keyboard device of the present invention that uses secondary pads to urge against the side portions.

Please refer to FIG. 6A, to eliminate the clicking sound made at sites A and B when the key top is pressed down, the keyboard device 20 further includes a first bottom pad 60 located on the conductive membrane 23 to urge against the protrusions 242 when the protrusions 242 move down. The first bottom pad 60 may be a silicone pad having a thickness of 1 mm. The protrusions 242 touch the first bottom pad 60, the first bottom pad 60 is depressed about 0.3 mm, which prevents the side portion 244 from contacting the top portion 22, and leaves a gap between the side portion 244 and the top portion 22. Because the side portion 244 does not hit the top portion 22, no sound occurs at site B. In this case, the distance of the gap is 0.7 mm, and the descending length DL of the key top 24 is 2.8 mm at this time. The first bottom pad 60 in FIG. 6A may be changed to a second pad 62 in FIG. 6B, and the second pad 62 is located on the butting column 21 to urge against the side portion 244 when the side portion 244 is moved down, to obtain the soundless effect at site B. The second pad 62 allows a first distance FD between the side portion 244 and the top portion 22. Similarly, the second pad 62 will simultaneously cause that the protrusion 242 cannot move toward the conductive membrane 23, and leave a gap between the protrusion 242 and the conductive membrane 23. Thus, the protrusion 242 will not hit the conductive membrane 23, and so site A is silent.

Figure 7:
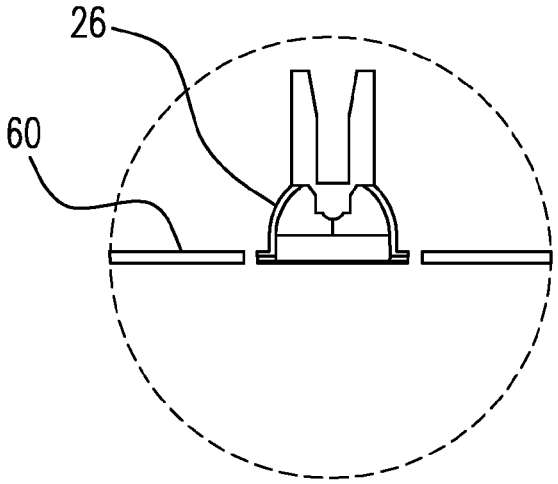
FIG. 7 is a schematic diagram illustrating that the bottom pad is independent from the silicone rubber dome.
Figure 8:
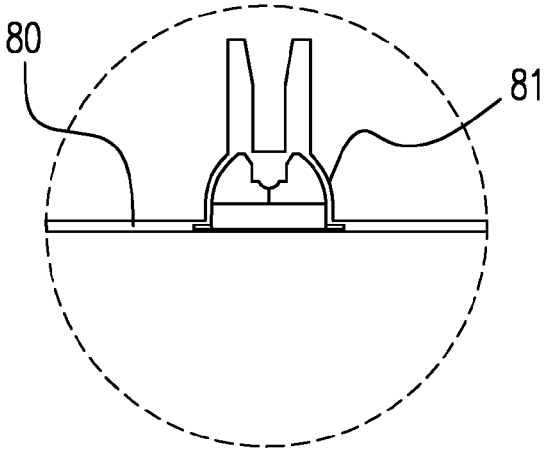
FIG. 8 is a schematic diagram illustrating that the bottom pad is integrated with the silicone rubber dome.

The first bottom pad 60 in FIG. 6A may be separated from the silicon rubber dome 26 as shown in FIG. 7, or integrated with the bottom pads of other keys to form an entire sheet for the bottom pad. The silicone material of the first bottom pad 60 may also be ethylene vinyl acetate (EVA), which also has the effect of eliminating the clicking sound. Of course, the first bottom pad 60 can also be changed to the pattern as shown in FIG. 8, in which the first bottom pad 80 is integrated with the silicone rubber dome 81.

From another point of view of the main technique, the keyboard device 20 of present invention includes an upper housing 281, a key top 24 moving in a vertical direction relative to the upper housing 281 in response to an actuating pressure, a lower housing 282, and an elastic body 26 disposed on the lower housing 282 bearing the actuating pressure and preventing the key top 24 from colliding with the upper housing 281 in the vertical direction when the key top 24 rebounds after the actuating pressure is released.

Figure 9A:
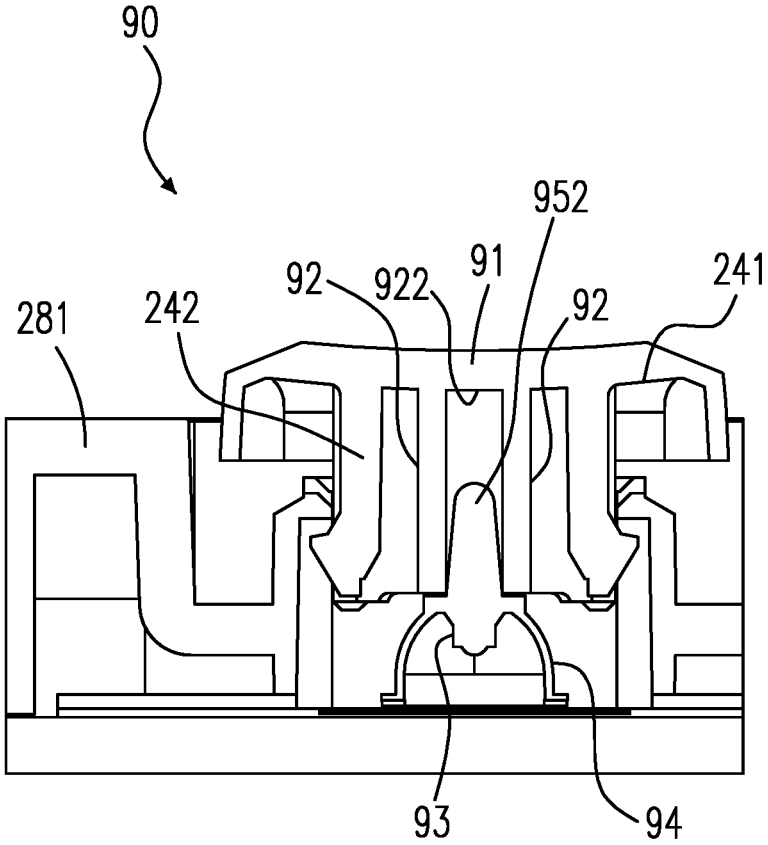
FIG. 9A is a cross-sectional view of the keyboard device according to another preferred embodiment of the present invention.
Figure 9B:
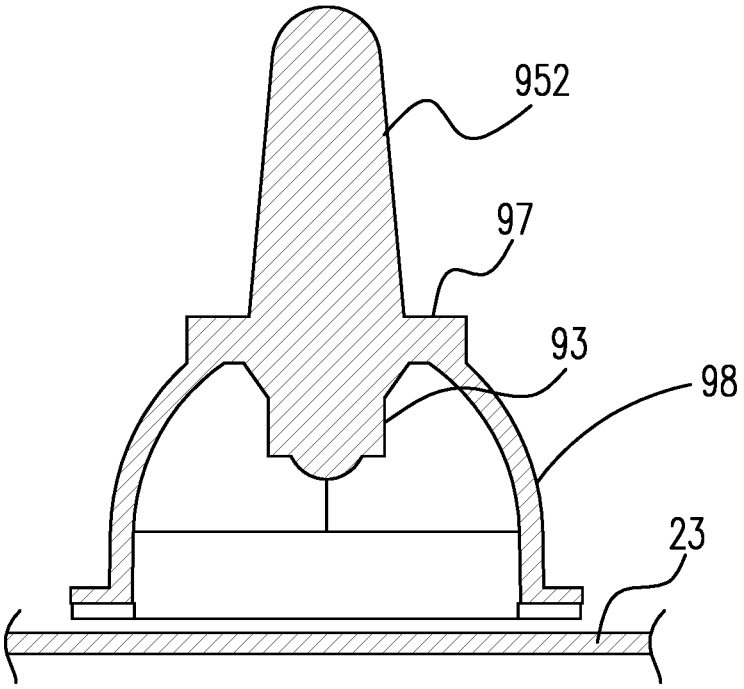
FIG. 9B is a cross-sectional view of the enlarged elastic body shown in FIG. 9A.

This keyboard device 20 further includes a conductive membrane 23, and the key top 24 includes a bottom surface 241 and an actuator 25 disposed on the bottom surface 241, wherein the actuator 25 moves in a vertical direction in the upper housing 281. Please refer to FIG. 9A showing a keyboard device 90. In order to avoid any silicone material fatigue in the first bottom pad and the resulting sound made at site A after long-term use due to the impact on the protrusion 242 over a long time, the actuator 25 may be modified as the actuator 2 in FIG. 9A. That is, the actuator 92 is a second recessed cylinder (also called the first holding portion) 92 that generates an actuating pressure in the vertical direction. The key top 91 does not hit the upper housing 281 directly in the vertical direction, the elastic body 93 includes a hemisphere 94 and a second central post (also called the second holding portion) 952 connected to the top of the hemisphere 94, and the second recessed cylinder 92 has a second central recess 922 to hold the second central post 952. Please refer to FIG. 9B, when the second recessed cylinder 92 pushes down on the elastic body 93, the buffer provided by two silicone layers 97, 98 of the elastic body 93 can also achieve the soundless effect at site A, and the configuration of the first bottom pad 60 can be omitted.

Figure 10:
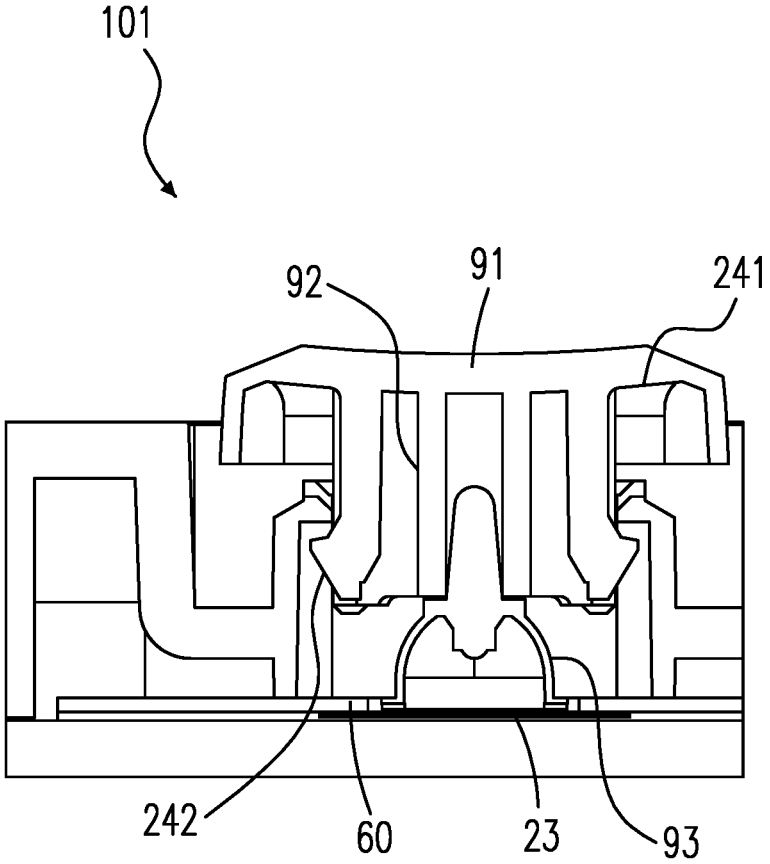
FIG. 10 is a cross-sectional view illustrating a first bottom pad disposed on the conductive membrane shown in FIG. 9A.

Please refer to FIG. 10, which illustrates that the key top 91 of the keyboard device 101 includes a bottom surface 241 and an actuator 92 which is a second recessed cylinder 92 disposed on the bottom surface 241. The key top 91 includes protrusions 242 disposed on the bottom surface 241. The keyboard device 101 further includes a first bottom pad 60 and a conductive membrane 23, wherein the first bottom pad 60 is located on the conductive membrane 23 to urge against the protrusions 242 when the key top 91 is pressed down, and thereby the first bottom pad 60 can share part of the pressure applied by the user and reduce the burden on the elastic body 93.

According to a further point of view, the present invention encompasses a keyboard device 20 having an upper housing 281 and a lower housing 282. The keyboard device 20 includes a key top 24 vertically and slidably disposed within the keyboard device 20, and an elastic body 26 disposed on the lower housing 282 and holding the key top 24 away from contacting with either the upper housing 281 or the lower housing 282 when the key top 24 rebounds when the key top 24 is removed from an external force. Of course, the upper housing 281 has a stopping surface 221, the elastic body 26 includes a holding structure (i.e. a higher part (also called the second holding portion) 27) and an elastic structure (i.e. a silicone rubber dome). The key top 24 has a first central post 25 and a protrusion 251, the upper housing 281 has a stopping portion (i.e. the top portion 22), and the protrusion 251 has an engaging surface 252. There is a second distance DT between the engaging surface 252 and the stopping surface 221. The elastic body 26 holds the first central post 25 such that the second distance DT is greater than zero when the key top 24 rebounds. The height of the stopping portion 22 may be less than a regular height (1.4 mm). The keyboard device 20 is a computer keyboard or a telephone keyboard. The depth that the elastic body 26 pulls back from the first central post 25 is used to determine the height of the second distance. This second distance DT is also relative to the length of the first central post 25 and the height of the silicone rubber dome.

The present invention may also be a keyboard device 20 having an upper housing 281 and a lower housing 282, and the keyboard device 20 includes a butting column 21, a key top 24 and an elastic body 26 (i.e. a silicone rubber dome). The butting column 21 is disposed on the upper housing 281, which has two stopping portions (i.e. the top portion 22) at the top. The key top 24 includes a bottom surface 241, a first central post 25 extending from the bottom surface 241 and two protrusions 242, wherein the protrusions 242 engage with the stopping portion to prevent the key top 24 from leaving the upper housing 281. The elastic body 26 includes an elastic base (shown in the cross section that is indicated by the reference numeral 26), a first bottom pad 60 and a top extending portion (i.e. the top part (also called the second holding portion) 27) connected to the elastic base, wherein the top extending portion holds the first central post 25 to prevent the protrusions 242 from contacting the stopping portion when the key top 24 rebounds when the key top 24 is removed from an external force. The protrusions 242 and the lower housing 282 are separated by the first bottom pad 60, and thereby the clicking sound made by hitting the lower housing 282 with the protrusions 242 is eliminated.

The present invention may also be a keyboard device 20 having an upper housing 281 and a lower housing 282, and the keyboard device 20 includes a butting column 21, a key top 24 and an elastic body 26 (i.e. a silicone rubber dome). The butting column 21 is disposed on the upper housing 281, which has two stopping portions (i.e. the top portion 22) at the top. The key top 24 includes a bottom surface 241, a first central post 25 extending from the bottom surface 241 and two protrusions 242, wherein the protrusions 242 engage with the stopping portion to prevent the key top 24 from leaving the upper housing 281. The elastic body 26 includes an elastic base (shown in the cross section that is indicated by the reference numeral 26) and a top extending portion (i.e. the top part 27) connected to the elastic base, wherein the top extending portion holds the first central post 25 to prevent the protrusions 242 from contacting the stopping portion when the key top 24 rebounds when the key top 24 is removed from an external force. When the protrusions 242 contact the lower housing 282, the bottom surface 241 does not contact the stopping portions, and thereby the clicking sound made when the bottom surface 241 hits the stopping portion is eliminated.

The present invention may also be a keyboard device 20 having an upper housing 281 and a lower housing 282, and the keyboard device 20 includes a butting column 21, a key top 24 and an elastic body 26 (i.e. a silicone rubber dome). The butting column 21 is disposed on the upper housing 281, which has two stopping portions (i.e. the top portion 22) at the top. The key top 24 includes a recess 245 and a first central post 25 and two protrusions 242 configured in the recess 245, wherein the protrusions 242 engage with the stopping portion to prevent the key top 24 from leaving the upper housing 281. The elastic body 26 includes an elastic base (shown in the cross section that is indicated by the reference numeral 26) and a top extending portion (i.e. the top part 27) connected to the elastic base, wherein the top extending portion holds the first central post 25 to prevent the protrusions 242 from contacting the stopping portion when the key top 24 rebounds when the key top 24 is removed from an external force.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

EMBODIMENTS

1. A keyboard device, including an upper housing, a conductive membrane, a key top including a bottom surface and an actuator disposed on the bottom surface, a lower housing and a soft elastic element located on the conductive membrane, wherein the actuator penetrates the upper housing, and the soft elastic element has an engaging part to engage with the key top such that the key top is prevented from being separated from the soft elastic element when the key top rebounds.

2. The keyboard device according to Embodiment 1, wherein the upper housing further includes a butting column having a top portion being a stopping portion, wherein the stopping portion will not be hit by the key top when the key top rebounds.

3. The keyboard device according to one of Embodiments 1 and 2, wherein the actuator is a central post penetrating the butting column.

4. The keyboard device according to any one of Embodiments 1 to 3, wherein the keyboard device is one of a conventional keyboard and a thin keyboard, and the bottom surface includes a recess where the first central post is located.

5. The keyboard device according to any one of Embodiments 1 to 4, wherein the soft elastic element is one of a silicone rubber dome and a rubber hemisphere, the engaging part is a recessed cylinder, and the recessed cylinder has a central recess for holding the central post.

6. The keyboard device according to any one of Embodiments 1 to 5, wherein the soft elastic element is one of a silicone rubber dome and a rubber hemisphere, the engaging part is a recessed cylinder, and the recessed cylinder has a central recess for holding the central post.

7. The keyboard device according to any one of Embodiments 1 to 6, wherein the key top further includes a protrusion configured on the bottom surface and having an engaging portion freeing from engaging with the top portion when the key top rebounds.

8. The keyboard device according to any one of Embodiments 1 to 7, further comprising a first bottom pad located on the conductive membrane to urge against the protrusion when the key top is pressed, thereby freeing the bottom surface from bumping against the top portion.

9. The keyboard device according to any one of Embodiments 1 to 8, wherein the first bottom pad is one of a silicone pad and an ethylene vinyl acetate (EVA) pad and provided in one of two states being separated from the silicon rubber dome and being integrated with the silicon rubber dome.

10. The keyboard device according to any one of Embodiments 1 to 9, further comprising a second pad located on the butting column to serve as a cushion between the bottom surface and the top portion.

11. A keyboard device, including an upper housing, a key top moving in a vertical direction relative to the upper housing in response to an actuating pressure, a lower housing, and an elastic body disposed on the lower housing, bearing the actuating pressure and holding the key top from colliding with the upper housing in the vertical direction while the key top rebounds after the actuating pressure is released.

12. The keyboard device according to Embodiment 11, wherein the key top comprises a bottom surface, an actuator disposed on the bottom surface, and a protrusion configured on the bottom surface, wherein the actuator is a recessed cylinder.

13. The keyboard device according to one of Embodiments 11 and 12, wherein the keyboard device further includes a bottom pad and a conductive membrane, and the bottom pad is located on the conductive membrane to urge against the protrusion when the key top is pressed down.

14. The keyboard device according to any one of Embodiments 11 to 13, further comprising a conductive membrane, wherein the key top comprises a bottom surface and an actuator disposed on the bottom surface, the actuator is a recessed cylinder that performs a vertical movement inside the upper housing and generates the actuating pressure in the vertical direction, the key top does not collide with the upper housing directly in the vertical direction, the elastic body comprises a hemisphere and a central post connected to the top of the hemisphere, and the recessed cylinder has a central recess for holding the central post.

15. A keyboard device having an upper housing and a lower housing, including a key top vertically slidably disposed within the keyboard device, and an elastic body disposed on the lower housing and holding the key top away from contacting with either one of the upper housing and the lower housing when the key top rebounds after the key top is removed from an external force.

16. The keyboard device according to Embodiment 15, wherein the upper housing has a stopping portion having a stopping surface, the key top has a central post and a protrusion having an engaging surface, there is a distance greater than zero between the engaging surface when the key top rebounds.

17. The keyboard device according to one of Embodiments 15 and 16, wherein the elastic body comprises a holding structure and an elastic structure.

18. The keyboard device according to any one of Embodiments 15 to 17, wherein the holding structure and the central post have an engagement used to determine to what extent the distance is greater than zero.

19. The keyboard device according to any one of Embodiments 15 to 18, wherein the elastic structure is one of a silicone rubber dome and a rubber hemisphere.

20. The keyboard device according to any one of Embodiments 15 to 19, which is one of a computer keyboard and a telephone keyboard.

What is claimed is:

1. A keyboard device, comprising:

an upper housing;

a conductive membrane;

a key top including a bottom surface and an actuator disposed on the bottom surface, wherein the actuator penetrates the upper housing and is also a first holding portion;

a lower housing; and an elastic element located on the conductive membrane, wherein the elastic element has an engaging part which is a second holding portion to hold the key top such that the first and the second holding portions are unattachably fixed together and the key top is prevented from hitting the upper housing when the key top rebounds.

2. The keyboard device as claimed in claim 1, wherein the upper housing further includes a butting column having a top portion being a stopping portion, wherein the stopping portion will not be hit by the key top when the key top rebounds.

3. The keyboard device as claimed in claim 2, wherein the actuator is a central post penetrating the butting column.

4. The keyboard device as claimed in claim 3, wherein the bottom surface includes a recess where the first central post is located.

5. The keyboard device as claimed in claim 3, wherein the elastic element is one of a silicone rubber dome and a rubber hemisphere, the engaging part is a recessed cylinder, and the recessed cylinder has a central recess for holding the central post.

6. The keyboard device as claimed in claim 5, wherein the elastic element is one of a silicone rubber dome and a rubber hemisphere, the engaging part is a recessed cylinder, and the recessed cylinder has a central recess for holding the central post.

7. The keyboard device as claimed in claim 2, wherein the key top further includes a protrusion configured on the bottom surface and having an engaging portion freeing from engaging with the top portion when the key top rebounds.

8. The keyboard device as claimed in claim 7, further comprising a first bottom pad located on the conductive membrane to urge against the protrusion when the key top is pressed, thereby freeing the bottom surface from bumping against the top portion.

9. The keyboard device as claimed in claim 8, wherein the first bottom pad is one of a silicone pad and an ethylene vinyl acetate (EVA) pad and provided in one of two states being separated from the silicon rubber dome and being integrated with the silicon rubber dome.

10. The keyboard device as claimed in claim 2, further comprising a second pad located on the butting column to serve as a cushion between the bottom surface and the top portion.

11. A keyboard device, comprising:

an upper housing;

a key top including a first holding, portion and moving in a vertical direction relative to the upper housing in response to an actuating pressure;

a lower housing; and an elastic body disposed on the lower housing, wherein the elastic body has a second holding portion and bears the actuating pressure, and the first and the second holding portions are unattachably fixed together to hold the key top from colliding with the upper housing in the vertical direction while the key top rebounds after the actuating pressure is released.

12. The keyboard device as claimed in claim 11, wherein the key top comprises a bottom surface, an actuator disposed on the bottom surface, and a protrusion configured on the bottom surface, wherein the actuator is a recessed cylinder.

13. The keyboard device as claimed in claim 12, wherein the keyboard device further includes a bottom pad and a conductive membrane, and the bottom pad is located on the conductive membrane to urge against the protrusion when the key top is pressed down.

14. The keyboard device as claimed in claim 11, further comprising a conductive membrane, wherein the key top comprises a bottom surface and an actuator disposed on the bottom surface, the actuator is a recessed cylinder that performs a vertical movement inside the upper housing and generates the actuating pressure in the vertical direction, the key top does not collide with the upper housing directly in the vertical direction, the elastic body comprises a hemisphere and a central post connected to the top of the hemisphere, and the recessed cylinder has a central recess for holding the central post.

15. A keyboard device having an upper housing and a lower housing, comprising:

a key top including a first holding portion and being vertically slidably disposed within the keyboard device; and an elastic body having a second holding portion and being disposed on the lower housing, wherein the first and the second holding portions are unattachably fixed together to hold the key top away from contacting with either one of the upper housing and the lower housing when the key top rebounds after the key top is removed from an external force.

16. The keyboard device as claimed in claim 15, wherein the upper housing has a stopping portion having a stopping surface, the key top has a central post and a protrusion having an engaging surface, there is a distance greater than zero between the engaging surface when the key top rebounds.

17. The keyboard device as claimed in claim 15, wherein the elastic body comprises a holding structure and an elastic structure.

18. The keyboard device as claimed in claim 17, wherein the holding structure and the central post have an engagement used to determine to what extent the distance is greater than zero.

19. The keyboard device as claimed in claim 15, wherein the elastic structure is one of a silicone rubber dome and a rubber hemisphere.

20. The keyboard device as claimed in claim 15, which is one of a computer keyboard and a telephone keyboard.

* * * * *